United States Patent [19]

Hidaka

[11] 4,213,133

[45] Jul. 15, 1980

[54] LINEAR ANTENNA ARRAYS

[75] Inventor: Kazutaka Hidaka, Yamato, Japan

[73] Assignee: Tokyo Shibaura Denki Kabushiki Kaisha, Kawasaki, Japan

[21] Appl. No.: 960,227

[22] Filed: Nov. 13, 1978

[30] Foreign Application Priority Data

Nov. 10, 1977 [JP] Japan ..... 52-135002
Aug. 28, 1978 [JP] Japan ..... 53-103803

[51] Int. Cl.[2] ..... H01Q 3/26
[52] U.S. Cl. ..... 343/854; 343/814
[58] Field of Search ..... 343/854, 754, 853, 778, 343/814, 100 SA, 100 LE

[56] References Cited

U.S. PATENT DOCUMENTS 3,255,450 6/1966 Butler ..... 343/854
4,131,896 12/1978 Miller ..... 343/854

FOREIGN PATENT DOCUMENTS 52-4146 1/1977 Japan .

OTHER PUBLICATIONS

Inagaki, N. and Sekiguchi, T., "Antenna Radiation Pattern Synthesis," Trans IECE of Japan, vol. 48, No. 4, p. 541, 4/65.
Teshirogi, K., "Realizable Method of Pattern Synthesis for Antenna Array," IEEE Trans AP-19, p. 11, 1/71.

*Primary Examiner*—David K. Moore
*Attorney, Agent, or Firm*—Oblon, Fisher, Spivak, McClelland & Maier

[57] ABSTRACT

The linear antenna array comprises three or more element antennae which are disposed along a straight line and a feed circuit network connected to the element antennae via an inversion circuit for inverting power in opposite phases. The feed circuit network comprises a plurality of power dividers having common ports connected to respective element antennae, and split ports of a number corresponding to a binomial coefficient, phase shifters respectively connected to the split ports, and a common power divider connected to the phase shifters.

13 Claims, 17 Drawing Figures

LINEAR ANTENNA ARRAYS

BACKGROUND OF THE INVENTION

This invention relates to a linear antenna array wherein three or more element antennae are arranged along a straight line, and more particularly an antenna array suitable for receiving television waves and frequency modulated signals.

As an television receiving antenna so called unidirectional antenna which is sensitive to electric waves coming from a given direction but not to electric waves in other directions has been used for the purpose of eliminating ghost signals caused by electric waves reflected by buildings. One example of such antenna is disclosed, for example, in Japanese laid open patent specification No. 4146 of 1977 dated Jan. 13, 1977. The most simple unidirectional antenna disclosed therein is a two element dipole array antenna of the phase difference feeding system in which two dipole antenna elements are arranged along a straight line with their antenna conductors disposed in parallel with a spacing d, and two feeder lines $l_1$ and $l_2$ having different lengths are connected between respective element antennae and the split ports of a splitting circuit which are divided into two ports from a common feed ports. The phase of either one of these two feeder lines is reversed by, for example, crossing two parallel conductors. When the lengths $l_1$ and $l_2$ of the two feeder lines and the spacing d between the antenna elements are selected to satisfy an equation:

$$\frac{1}{K}(l_1 - l_2) = d$$

where K is a wavelength compression coefficient, the antenna would receive electric waves in the direction of a straight line along which the antenna elements are arrayed, but not electric waves coming from other directions. The unidirectional antenna of the phase difference feeding type is characterized in that the unidirectional performance of the directivity does not vary irrespective of the variation in the frequency of the received waves. In other words, it is possible to obtain a directive antenna over a wide frequency band.

However, in such two element antenna, the direction in which the directivity is the maximum or minimum (null point direction) is only one for each direction. However, the direction of arriving the ghost signals in the reception of television waves is not generally limited to one, and in most cases the ghost signals come from a number of directions. For this reason, in order to eliminate ghost signals, it has been strongly desired to provide an antenna which have a plurality of null directions and which can install the null points in an arbitrary direction. However, until today there was no antenna that can meet such requirement over a wide frequency band.

To satisfy these requirements it is necessary to increase the number of the antenna elements and to use a special method of feeding that assures a desired directivity. According to said Japanese laid open patent specification No. 4146 of 1977, $2^n$ dipole antenna elements are arrayed along a straight line and the phase difference feed system is used. However, the object of this antenna array is to make more sharper the directivity of the two elements antenna thereby improving the ratio between the maximum and the minimum values of the directivity, that is the front to back ratio characteristic, and this laid open patent specification does not teach the installation of null points in a plurality of difference directions as contemplated by the instant invention.

SUMMARY OF THE INVENTION

Accordingly, it is an object of this invention to provide an improved linear antenna array having more than two null point directions and can not only install these null point directions in desired directions but also always maintain in specified directions these null points regardless of the frequency.

Another object of this invention is to provide a novel antenna array capable of providing a maximum number of the null points with a minimum number of the element antennae.

A further object of this invention is to provide a linear antenna array having a definite directivity over a wide frequency band.

According to this invention there is provided a linear antenna array comprising three or more than three element antennae which are arranged on a straight line; a plurality of power dividers respectively corresponding to the element antennae, each power divider being provided with split ports of a number corresponding to a binomial coefficient, which is expressed by an equation $p_i = {}_{n-1}C_{i-1}$ where $p_i$ represents the number of ports, n the number of antenna elements, and i the number of a corresponding antenna counted from one end of the array and a common port connected to a feed port of an element antenna; a plurality of phase shifters having one ends connected to the split ports of the power dividers; each of the phase shifters producing a phase shift which varies in proportion to frequency; and a common power divider having split ports connected to the other ends of the phase shifters and common ports acting as feed ports, whereby to alternately reverse the phase between the feed port of the common power divider and the feed ports of respective element antennae.

BRIEF DESCRIPTION OF THE DRAWINGS

These and further objects, the principle of operation and the specific advantages of the invention can be more fully understood from the following detailed description taken in conjunction with the accompanying drawings in which.

DETAILED DESCRIPTION OF THE PREFERRED EMBODIMENTS

Figure 1A:
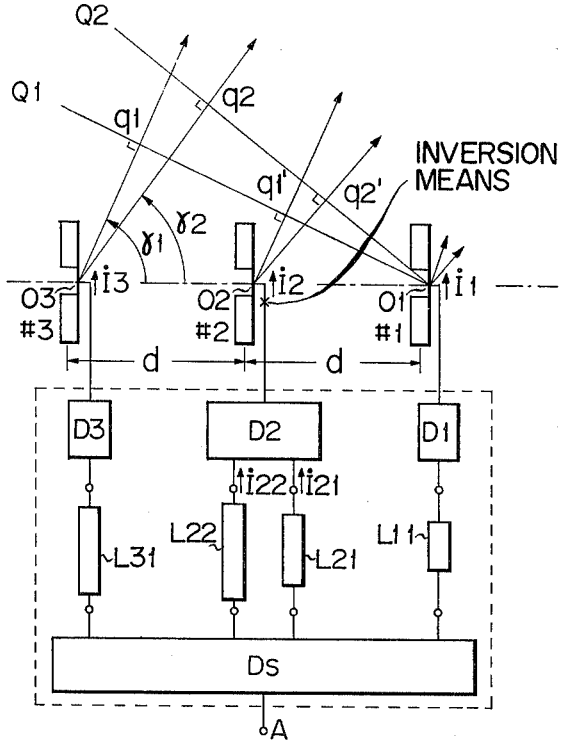
FIGS. 1A, 1B and 1C are a block diagram and vector diagrams respectively showing the principle of operation of one embodiment of this invention utilizing a three-element antenna.
Figure 1B:
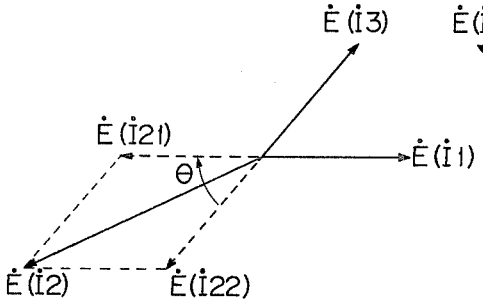
Figure 1C:
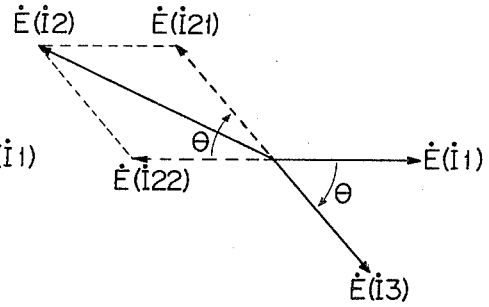

With reference to FIGS. 1A, 1B and 1C, the principle of this invention utilizing 3 element antennae will firstly be described.

The embodiment shown in FIG. 1 comprises three element antennae #1, #2 and #3 which are arranged along a straight line with a spacing d therebetween. Each element antenna comprises a dipole antenna, for example.

The feed lines of the second antenna cross each other as its feed port so as to invert 180° the phase of the current fed to this element antenna #2. A feed network bounded by dotted lines and connected to three element antennae #1, #2 and #3 is constructed as follows. More particularly, the feed network comprises a common power divider $D_s$ constructed to apply four signals having substantially the same phase to respective split ports, phase shifters $L_{11}$, $L_{21}$, $L_{22}$ and $L_{31}$ respectively connected to the split ports of the common power divider $D_s$, a one-way divider $D_1$ connected between the phase shifter $L_{11}$ and the first element antenna #1, a two-way divider $D_2$ with its split port connected to the outputs of phase shifters $L_{21}$ and $L_{22}$ and its common port connected to the second element antenna #2, and a one-way divider $D_3$ connected between the phase shifter $L_3$ and the third element antenna #3.

Each power divider functions to divide a signal among the split ports when the signal is supplied thereto from the common port. Conversely, when the signal is applied to the divider through the split port, it produces a superposed signal output on the common port, thus acting as a combiner. For the sake of brevity, the term "divider" is used not only for a case where a signal is applied through the common port but also for a case where the signal is applied through the split port.

The one-way dividers $D_1$ and $D_3$ are not required to have a dividing performance. But for the purpose of clarifying the relationship between the explanation for FIG. 1A and the description of the general principle it is designated as a one-way divider.

Let us denote the exciting currents of the first, second and third element antennae #1, #2 and #3 by $\dot{I}_1$, $\dot{I}_2$ and $\dot{I}_3$ respectively. Neglecting the loss of the circuit elements in the circuit, the exciting current $\dot{I}_1$ of the first element antenna #1 accompanies a delay thereof which is supplied from the power divider $D_s$ to the phase shifter $L_{11}$ and then supplied to the first element antenna #1 via the phase shifter $L_{11}$, and the one-way divider $D_1$. The exciting current $\dot{I}_3$ supplied to the third element antenna #3 accompanies a delay thereof which is supplied from power divider $D_s$ to the third element antenna #3 through the phase shifter $L_{31}$ and the one-way divider $D_3$.

Accordingly, if the amplitude of the current produced at the split port connected to the phase shifter $L_{11}$ of the power divider $D_s$ is made to be equal to that of the current produced at the split port connected to the phase shifter $L_{31}$ of the power divider $D_s$, current $\dot{I}_1$ and $\dot{I}_3$ would have the same amplitude but different phases.

Current $\dot{I}_2$ is a vector sum of currents $\dot{I}_{21}$ and $\dot{I}_{22}$. $\dot{I}_{21}$ represents current which is supplied from the common divider $D_s$ to the second element antenna #2 and delayed by the phase shifter $L_{21}$ and the two-way divider $D_2$. $\dot{I}_{22}$ represents which is supplied from the common divider $D_s$ to the second element antenna #2 and delayed by the phase shifter $L_{22}$ and the two-way divider $D_2$.

Each of the phase shifters $L_{11}$, $L_{21}$, $L_{22}$ and $L_{31}$ is a line type phase shifter utilizing a transmission line whose amount of phase shift is varied by varying the length thereof, and for convenience the lengths of the transmission lines of respective phase shifters are designated by the same reference characters $L_{11}$, $L_{21}$ $L_{22}$ and $L_{31}$.

In the linear antenna array shown in FIG. 1A, since the number of the element antennae is 3 it is possible to form null points having no radiation in any two directions as will be described hereinunder.

Suppose now that a first null point is to be formed in a direction $\gamma_1$ as shown in FIG. 1A. This can be accomplished by making zero the vector sum of electric fields $\dot{E}_1(\dot{I}_1)$, $\dot{E}_2(\dot{I}_2)$ and $\dot{E}_3(\dot{I}_3)$ created in a wave front $O_1$-$Q_1$ corresponding to the direction $\gamma_1$ by the exciting currents $\dot{I}_1$, $\dot{I}_2$ and $\dot{I}_3$ supplied to the first, second and third antennae. Taking the electric field $\dot{E}_1(\dot{I}_1)$ created by the first antenna #1 in the wave front $O_1$-$Q_1$ as a reference, field the electric field $\dot{E}_3(\dot{I}_3)$ created by the third element antenna #3 is delayed by an amount corresponding to the distance between the third element antenna #3 and the $O_1$-$Q_1$ wave front so that it can be shown by a vector $\dot{E}(\dot{I}_3)$ shown in FIG. 1B.

Since the amount of the phase lag at point $q_1$ can be varied as desired by varying the amount of phase shift effected by the phase shifter $L_{31}$ the direction of vector $E(I_3)$ shown in FIG. 1B can be determined arbitrarily.

If the direction of one null point is appointed as above described, the amount of relative phase shift at point $q_1$ is determined by adjustment of the phase shifter $L_{31}$ in accordance with the distance between the third element antenna #3 and point $q_1$. At this time, if an electric field $\dot{E}(\dot{I}_2)$ that cancells fields $\dot{E}(\dot{I})$ and $\dot{E}(\dot{I}_3)$ were created by the second element antenna #2, a null point would be formed in the direction of $\gamma_1$.

The electric field $\dot{E}(\dot{I}_2)$ may be formed by the reverse phase component of field $\dot{E}(\dot{I}_1)$ and the reverse phase component of field $\dot{E}(\dot{I}_3)$. The phase of the electric field $\dot{E}(\dot{I}_{21})$ created by the exciting current $\dot{I}_{21}$ flowing through the phase shifter $L_{21}$ can be varied by varying the amount of phase shift effected by the phase shifter $L_{21}$. Accordingly, it is possible to cause the fields $\dot{E}(\dot{I}_{21})$ and $\dot{E}(\dot{I}_1)$ to have equal amplitude and opposite phases by suitably selecting the amount of phase shift of the phase shifter $L_{21}$ by taking into consideration the distance between the second element antenna #2 and the wave front $O_1$-$Q_1$. Similarly, it is possible to cause the field $\dot{E}(\dot{I}_{22})$ created by the current $\dot{I}_{22}$ flowing through the phase shifter $L_{22}$ to have the same amplitude and the opposite phases at the field $\dot{E}(\dot{I}_3)$ by suitably selecting the amount of phase shift of the phase shifter $L_{22}$.

However, since the second element antenna #2 is crossed at the feed port so as to reverse the phase of the current, except the effect of crossing, it is sufficient to cause the fields $\dot{E}(\dot{I}_{21})$ and $\dot{E}(\dot{I}_{22})$ to have the same phases as the fields $\dot{E}(\dot{I}_1)$ and $\dot{E}(\dot{I}_3)$ respectively.

When one null point direction is determined in a manner described above, the second null point direction would be determined automatically.

More particularly, considering the direction of $\gamma_2$, the wave front in this direction becomes $O_1$-$Q_2$. At this time, the amount Q of the phase shift is shown in FIGS. 1B and 1C such that the Q corresponds to the difference $(l_2'-l_1)$ between the distance $l_2'$ between the center $0_2$ of the second element antenna #2 and a point $q_2'$ and the distance $l_1$ between the center $O_2$ and point $q_1'$. If the field $\dot{E}(\dot{I}_{22})$ shown in FIG. 1B is rotated (lagged) by 0, the field $\dot{E}(\dot{I}_1)$ becomes a position which is just opposite to field $\dot{E}(\dot{I}_{22})$ as shown in FIG. 1C. Then the phases of the fields $\dot{E}(\dot{I}_{21})$ and $\dot{E}(\dot{I}_{22})$ are also lagged by 0. Because the field $\dot{E}(\dot{I}_{21})$ created by current $\dot{I}_{21}$ and the field $\dot{E}(\dot{I}_{22})$ created by current $\dot{I}_{22}$ are formed by the electric wave radiated by the same second element antenna #2, so that, with reference to direction $\gamma_1$, direction $\gamma_2$ results in a phase lag corresponding to the difference $(l_2'-l_1)$. For this reason, considering the field for the direction $\gamma_2$, both fields $\dot{E}(\dot{I}_{22})$ and $\dot{E}(\dot{I}_{21})$ shown in FIG. 1B rotate in the clockwise direction by $\theta$. Under these conditions, field $\dot{E}(\dot{I}_3)$ rotates by a phase lag corresponding to the difference between the distance $\overline{0q_2}$ between the center $0_3$ of the third element antenna and point $q_2$, and the distance $\overline{Oq_1}$.

Comparing $\Delta O_1O_3q_1$ and $\Delta O_1O_2q_1'$, since $\overline{O_1O_2}=\overline{O_2O_3}=d$ and $\angle q_1O_1O_3=\angle q_1'O_1O_2$, $\overline{O_3q_1}=\overline{20_2q_1'}=2l_1$. Similarly, comparing $\Delta O_1O3\ q_2$ and $\Delta O_1O_2q_2'$, since $\overline{O_1O_2}=\overline{O_20_3}=d$, and $\angle q_2O_1O_3=\angle q_2'O_1O_3$, $\overline{O_3q_2}=\overline{20_2q_2'}=2l_2$. As a result, the phase of the field $\dot{E}(\dot{I}_3)$ in the direction of $\gamma_2$ with respect to direction $\gamma_1$, would lag by an angle corresponding to $\overline{O_3q_2}-\overline{O_3q_1}=2l_2-2l_1=2(l_2-l_1)$. As above described, a phase lag of electrical angle $\theta$ is caused by the difference $l_2-l_1$ so that the field $\dot{E}(\dot{I}_3)$ would lag by an electrical angle $2\theta$, in other words, would rotate $2\theta$ in the clockwise direction when represented by the vector diagram.

As shown in FIG. 1B, since the electrical angle between field vectors $\dot{E}(\dot{I}_1)$ and $\dot{E}(\dot{I}_3)$ is $\theta$, when the field $\dot{E}(\dot{I}_3)$ rotates $2\theta$ in the clockwise direction, the field $\dot{E}(\dot{I}_3)$ would allocate a position which is symmetrical with respect to $\dot{E}(\dot{I}_1)$. Consequently, field $\dot{E}(\dot{I}_3)$ would lag by $\theta$ with respect to field $\dot{E}(\dot{I}_1)$. On the other hand, since field $\dot{E}(\dot{I}_{21})$ lags by $\theta$ with respect to the vector shown in FIG. 1B, field vectors $\dot{E}(\dot{I}_{21})$ and $\dot{E}(\dot{I}_3)$ would become just opposite. Thus, where a null point is selected in the direction of $\gamma_2$, $\dot{E}(\dot{I}_{22})$ would cancel $\dot{E}(\dot{I}_1)$ and $\dot{E}(\dot{I}_{21})$ would cancel $\dot{E}(\dot{I}_3)$.

As above described, when the direction of one null point is determined, for instance in the direction of $\gamma_1$, the direction in which the other null point is formed is also determined. More particularly, when it is selected in FIG. 1A that $\overline{O_2q_2'}-\overline{O_2q_1'}=l_2-l_1$, the second null point would be formed in a direction corresponding to electrical angle $\theta$, in FIG. 1B. However, at the time of determining the first null point direction $\gamma_1$, it is possible, independently on $\gamma_1$, to vary as desired the direction of vector $\dot{E}(\dot{I}_3)$ shown in FIG. 1B by varying the amount of phase shift imparted by the phase shifter $L_{31}$. In short, according to this invention, when the number of the element antennae is 3 it is possible to establish null points in any two directions.

The reason that the directions of these null points do not vary over a wide frequency band will now be described. Generally, in a transmission line having a definite length, the phase of the current flowing therethrough lags in proportion to the frequency. However, in the arrangement shown in FIG. 1A, the phase lags of waves originating from the divider $D_s$ and passing through respective phase shifters, respective dividers $D_1$, $D_2$, $D_3$, respective element antennae to reach wave fronts $O_1$-$Q_1$ and $O_1$-$Q_2$ respectively are equal and proportional to the frequency. Since the connection for the second element antenna #2 is crossed at the feed port to cause the currents to have opposite phases independently of the frequency, except the effect of crossing, the phases of the waves at the two wave fronts would lag which maintaining the same phase relations that the file $E(I_1)$ is equal to $E(I_{21})$ or $E(I_{22})$ and $E(I_3)$ is equal to $E(I_{22})$ or $E(I_{21})$. For this reason, in said direction $E(I_1)$ cancels $E(I_{21})$ or $E(I_{22})$ and $E(I_3)$ cancels $E(I_{22})$ or $E(I_{21})$ independently of the frequency.

The principle of this invention will be described hereunder with the aid of mathematical equations with regard to a general case wherein the number of element antennae is n.

Figure 2A:
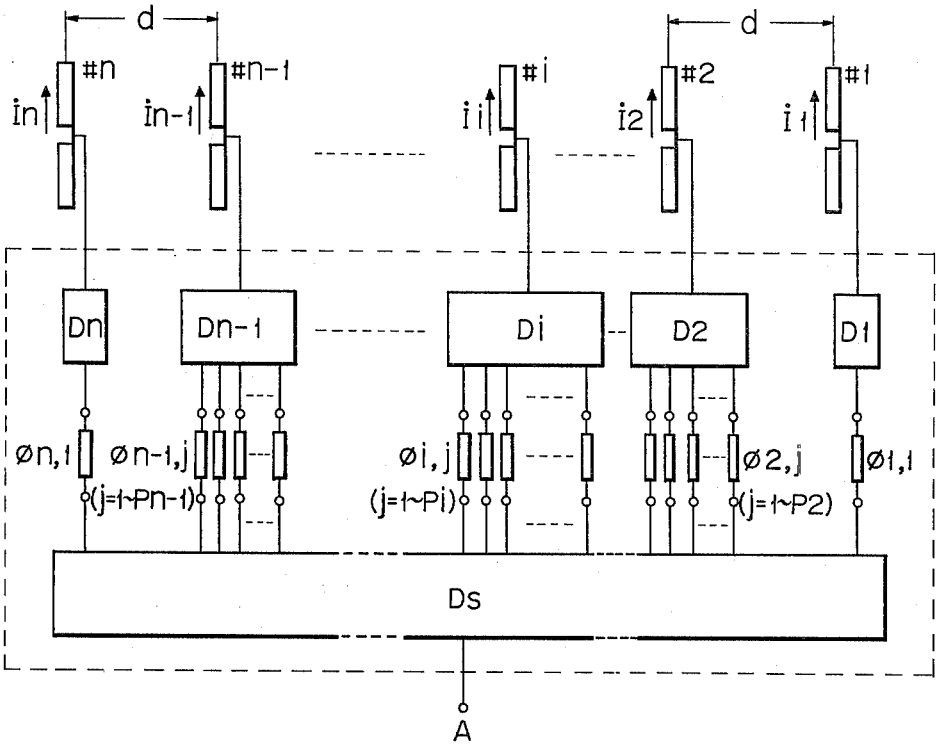
FIGS. 2A, 2B and 2C are a block diagram and its detailed diagrams respectively useful to explain the principle of this invention utilizing n element antennae.

FIG. 2A is a block diagram showing a linear antenna array of such case which comprises n element antennae #1 through #n which are arranged on a straight line with an equal spacing d. Each element antenna may comprise a dipole antenna. A portion bounded by dotted lines comprises a feed network which characterizes the invention and is constructed as follows. More particularly, it includes first dividers $D_1$ through $D_n$ corresponding to respective element antennae #through #n. The common ports of these dividers are connected to the feed ports of respective element antennae #1 through #n, directly or through lines, amplifiers, frequency converters, balance-unbalance circuit and the like. Each of the first dividers, $D_1$ through $D_n$ includes split ports of a number equal to a binomial coefficient expressed by the following equation (1).

$$P_i={}_{n-1}C_{i-1} \tag{1}$$

where $P_i$ represents the number ports, and i represents the number of the corresponding element antenna counted from the right-hand end as viewed in FIG. 2A and i=1, 2 . . . n. Thus, the total number S of the split ports is shown by $$S=\sum_{i=1}^{n} {}_{n-1}C_{i-1} \tag{2}$$

$D_s$ represents a common power divider having S split ports and phase shifters $\phi_{ij}$ are connected between the split ports of the common power divider $D_s$ and the split ports of the first power dividers $D_1$ through $D_n$ respectively. The first suffix i of the phase shifter symbol $\phi_{ij}$ represents the number of the corresponding element antenna, whereas the second suffix j represents the number of the split port of the corresponding first power dividers. The common port of the common power divider $D_s$ is termed a feed port A. In this feed network, for the purpose of alternately reversing the phases between the feed port A and the feed ports of respective element antennae #1 through #n, the connections of the common ports of the first power dividers $D_1$ through $D_n$ are alternately crossed and then connected with the feed ports of respective element antennae #1 through #n. As the power divides $D_1$ through $D_2$ and $D_s$, it is used a power divider having a high degree of isolation between respective split ports.

It is sufficient to construct the feed network such that the exciting currents transferred to the feed ports of respective element antennae from the feed port A through respective phase shifters would have the same amplitude with respct to each branch path for the reason described hereinafter but their phases are delayed by the phase shifters. Actually, it should be taken into consideration the phase delay between the input and output of the power divider, but for the convenience such phase delay is treated by including in the amount of phase shift afforded by the phase shifter. The power divider is generally provided with a number of split ports, but in the following description such dividers such as $D_1$ and $D_n$ having only one split port is also called a power divider.

The reason that the directivity can be synthesized over a wide frequency band in the linear antenna array shown in FIG. 2A will now be described. Suppose now that respective element antennae #1, #2, . . . #n are supplied with exciting currents $\dot{I}_1, \dot{I}_2 \ldots \dot{I}_n$ respectively as shown in FIG. 2A and that these element antennae are disposed along the x axis of a polar coordinate system at an equal spacing d with the first antennae element #1 positioned at the origin. Then the array factor $D(\theta,\phi)$ can be shown by the following equation;

$$D(\theta, \phi) = \sum_{i=1}^{n} \dot{I}_i \times \exp\{j\beta d(i-1)\sin\theta \cdot \cos\phi\} \tag{3}$$

where $=2\pi/\lambda$, $\lambda$ is wavelength.

putting now $$Z = \exp(j\beta d \sin\theta \cdot \cos\phi) \tag{4}$$

the equation (3) can be modified as follows.

$$D(\theta, \phi) = \sum_{i-1}^{n} \dot{I}_i Z^{i-1} \tag{5}$$

As has been pointed out hereinabove, since it is not always necessary that the element antennae are dipole antennae, we can express the directivity of a commonly used radiation element as $f(\theta, \phi)$. Then the superposed directivity $F(\theta, \phi)$ is given by $$F(\theta, \phi) = D(\theta, \phi) \cdot f(\theta, \phi) \tag{6}$$

In order to attain the object of this invention, that is to synthesize a desired directivity pattern over a wide frequency band, it is necessary to determine the exciting currents $\dot{I}_i$ ($i=1\sim n$) such that the array factor $D(\theta, \phi)$ will have null points in a given direction independently of the frequency.

The equation (5) has $(n-1)$ roots since it is a complex coefficient polynomial of order $(n-1)$. In other words, the array factor $D(\theta, \phi)$ may have $(n-1)$ null points. To obtain the exciting current $\dot{I}_i$ ($i=1\sim n$) described above, I use the relation between roots and the coefficients of the algebraic equation shown as (5). Thus, when the roots of equation (5) are denoted by $t_1, t_2, \ldots t_{n-1}$ respectively, there are the following relation.

$$\left.\begin{aligned} \dot{I}_{n-1} &= -\dot{I}_n(t_1 + t_2 + \ldots + t_{n-1}) \\ \dot{I}_{n-2} &= \dot{I}_n(t_1t_2 + t_1t_3 + \ldots + t_{n-2}t_{n-1}) \\ &\vdots \\ \dot{I}_1 &= (-1)^{n-i}\dot{I}_n(t_1 \cdot t_2 \cdot \ldots \cdot t_{n-1}) \end{aligned}\right\} \tag{7}$$

Generally, equation (7) can be rewritten as follows $$\dot{I}_i = (-1)^{n-i}\dot{I}_n \sum_{k_{i+1}=k_i+1}^{i} \sum_{k_{i+1}=k_{i+i}+1}^{i+1} \sum_{k_{i+2}}^{i+2} \sum_{\substack{k_{n-1} \\ =k_{n-2}+1}}^{n-1} (t_{k_i} \cdot t_{k_{i+1}} \cdot t_{k_{i+2}} \cdot \ldots \cdot t_{k_{n-1}}) \tag{8}$$

where $i=(1\sim n-1)$.

By the relation shown in equation (4), since the roots $t_1, t_2, \ldots t_{n-1}$ are located on a unit circle of the complex coefficient plane, they can generally be shown by $$t_k = \exp(j\beta d \sin\theta_k \cos\theta_k) \tag{9}$$

where $k=1\sim n-1$.

Accordingly, equation (8) can be rewritten $$\dot{I}_i = (-1)^{n-i}\dot{I}_n \sum_{k_{i=1}=k_i+1}^{i} \sum_{k_{i+l}=k_{i+1}+1}^{i+1} \sum_{k_{i+2}}^{i+2} \sum_{\substack{k_{n-1} \\ =k_{n-2}+1}}^{n-1} \exp\{j\beta d(\sin\theta_{k_i}\cos\phi_{k_i} + \sin\theta_{k_{i+1}}\cos\phi_{k_{i+1}} + \sin\theta_{k_{i+2}}\cos\phi_{k_{i+2}} + \ldots + \sin\theta_{k_{n-1}}\cos\phi_{k_{n-1}})\} \tag{10}$$

where $i=1\sim n-1$.

As can be noted from equation (10) when the direction $(\theta_k, \phi_k)$ of a null point of the directivity pattern is designated, current $\dot{I}_i$ varies with the frequency, that is $\beta$, so long as $\dot{I}_i$ is given, the null point directions of the directivity pattern which is designated at first can be maintained over a wide band.

The term $(=1)^{n-i}$ on the right-hand side of equation (10) shows that the phase is reversed at alternate element antannae in addition to the fact that the phases of the exciting currents of respective element antennae are shifted by the phase shifters. To accomplish this, where the power dividers $D_1$ through $D_n$ and $D_s$ are of the type that divide a signal into the same phase, the connections of the common ports of the dividers $D_1$ through $D_n$ to the feed ports of respective element antennae #1 through #n are alternately crossed. When the connections of the common ports of the power dividers $D_1$ through $D_n$ are alternately reversed, the following equation (11) may be used in which the term $(-1)^{n-1}$ in equation (10) has been excluded.

$$j\beta i = \dot{I}_n \sum_{k_{i=1}=k_i+1}^{i} \sum_{k_{i+1}=k_{i+1}+1}^{i+1} \sum_{k_{i+2}}^{i+2} \sum_{\substack{k_{n-1} \\ k_{n-2}+1}}^{n-1} \exp\{j\beta d(\sin\theta_{k_i}\cos\phi_{k_i} + \sin\theta_{k_{i+1}}\cos\phi_{k_{i+1}} + \sin\theta_{k_{i+2}}\cos\phi_{k_{i+2}} + \ldots + \sin\theta_{k_{n-i}}\cos\phi_{k_{n-i}})\} \tag{11}$$

where $i=1\sim n-1$.

Thus, according to the antennae of this invention, the exciting current shown by equation (11) is given by the feed network shown in FIG. 2A.

Figure 2B:
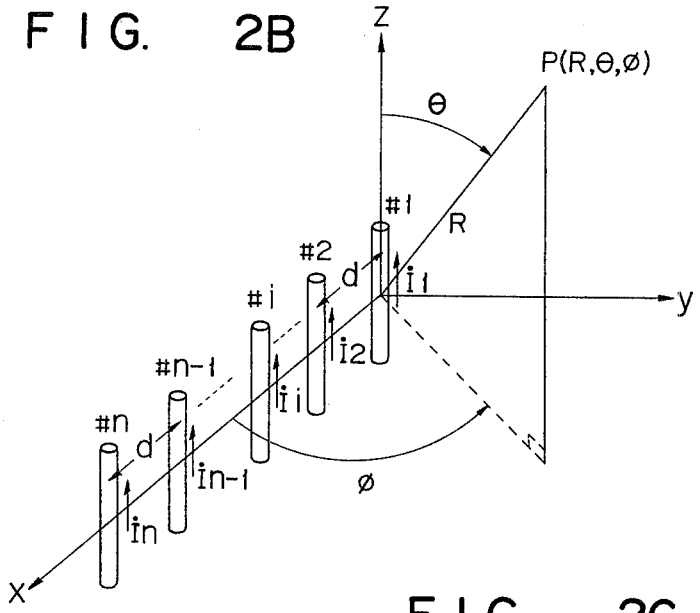
Figure 2C:
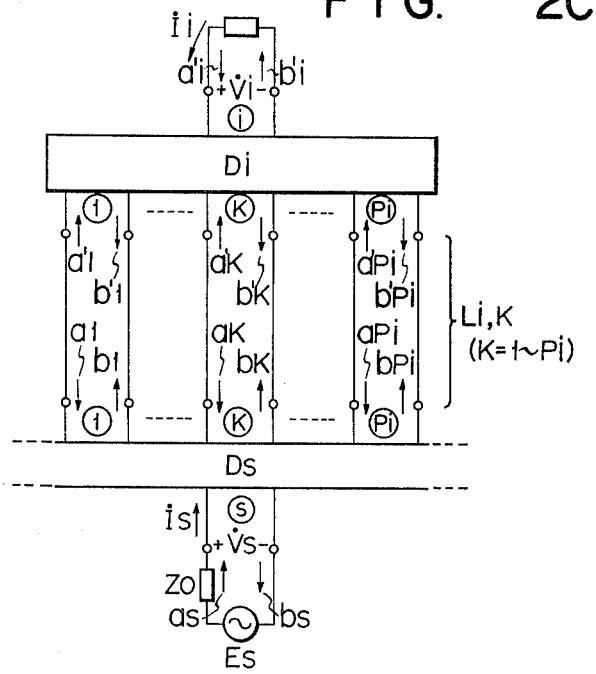

The principle of operation of the feed circuit network will now be described with reference to FIG. 2C which shows the feed network section for the i-th element antenna #i shown in FIG. 2A. It is possible to explain the principle generally, because i represents any one of 1 through n. In FIG. 2C the description of the invention is taken for short under the condition that each port is matched with the reference impedence $Z_O$. An S-matrix element (an element of a scattering matrix) between the common port (s) and the split port (k) of the common power divider $D_s$ is denoted by $S_{k,s}^{(i)}$ (which is equal to $S_{s,k}^{(i)}$ due to the reciprocity theorem). Then, the split ports are sufficiently isolated as above described, so that the incident wave $a_k$ and the reflected wave $b_k$ at the port (k) are shown as follows.

$$\left.\begin{aligned} a_k &= 0 \\ b_k &= S_{k,s}^{(i)} \cdot \frac{\dot{E}_s}{2\sqrt{Z_0}} \end{aligned}\right\} (k = 1 \sim p_i) \tag{12}$$

On the other hand, the incident wave $a'_k$ and the reflected wave $b'_k$ at the split port of the first power divider $D_i$ are expressed by the following equations.

$$\left.\begin{aligned} a'_k &= b_k \cdot \exp(-j\beta L_{i,k}) \\ b'_k &= 0 \end{aligned}\right\} (k = 1 \sim p_1) \tag{13}$$

where $L_{i,k}$ represents the electrical length of a transmission line which comprises a phase shifter $\phi_{ik}$ and $\beta=\lambda/2\pi$ ($\lambda$: wavelength). Denoting the S-matrix element between the split port (k) and the common port (i) of the power divider $D_i$ by $S'_{ik}$ (which is equal to $S'_{ki}$ due to the reciprocity thereom), the incident wave $a'_i$ and the reflected wave $b'_i$ at the port (i) are expressed by $$\left.\begin{aligned} a'_i &= O \\ b'_i &= \sum_{k=1}^{p_i} S'_{i,k} a'_k \end{aligned}\right\} \tag{14}$$

Due to the definition of S parameter, where a load having a reference impedance is connected to the port (i)

$$b'_i = -\sqrt{Z_O}\,\dot{I}_i \quad \ldots (15)$$

so that the exciting current $\dot{I}_i$ supplied to the i-th element antenna #i can be derived out as follows from equations (12), (13), (14) and (15).

$$I_i = -\sum_{k=1}^{p_1} \{S'_{i,k} \cdot S_{k,s}^{(i)} \cdot \exp(-j\beta L_{i,k})\} \frac{\dot{E}_s}{2Z_0} \tag{16}$$

where $i=1\sim n$.

According to this invention, the exciting current shown in equation (11) which is necessary for synthesizing a directivity pattern over a wide frequency band can be obtained by the exciting current shown by equation (16).

From equation (16), since $$\dot{I}_n = \frac{\dot{E}_s}{2Z_0} \cdot \exp(-j\beta L_{n,1}) \cdot S'_{n,1} \cdot S_{1,s}^{(n)} \tag{17}$$

it is possible to put equal the exciting currents expressed by equations (11) and (16) thus obtaining the following equation.

$$\begin{aligned} &\sum_{k=1}^{p_i} S'_{i,k} \cdot S_{k,s}^{(i)} \cdot \exp\{-j\beta(L_{i,k}-L_{n,1})\} \\ &= S'_{n,1} \cdot S_{1,s}^{(n)} \sum_{k_i=1}^{i} \sum_{k_{i+1}}^{i+1} \sum_{k_{i+2}}^{i+2} \\ &\qquad = k_i + 1 = k_{i+1} + 1 \end{aligned} \tag{18}$$

$$\begin{aligned} &\sum_{k_{n-1}}^{n-1} \exp\{j\beta d(\sin\theta_{k_i}\cos\phi_{k_i} + \sin\theta_{k_{i+1}}\cos\phi_{k_{i+1}} + \\ &= k_{n-2} + 1 \ldots + \sin\theta_{k_{i+2}}\cos\phi_{k_{i+2}} + \sin\theta_{k_{n-1}}\cos\phi_{k_{n-1}})\} \end{aligned} \tag{18}$$

where $i=n\sim n-1$.

Accordingly, when the S-matrix elements $S_{i,k}'$ and $S_{k,s}^{(i)}$ and the transmission line length (electrical length) $L_{i,k}$ of the phase shifter are set such that the equation (18) always holds irrespective of the variation in the frequency, it becomes possible to realize a directivity pattern having (n−1) null points in the desired or designated direction over a wide frequency band with the circuit construction shown in FIG. 2A. To this end, it is sufficient to satisfy the following design conditions.

$$S_{i,k}' \cdot S_{k,s}^{(i)} = \text{constant} \quad \ldots (19)$$

wherein $i=1\sim n$ and $k=1\sim p_i$. Because, the following equation can be obtained by substituting equation (19) into equation (18)

$$\begin{aligned} &\sum_{k=1}^{p_1} \exp\{-j\beta(L_{i,k}-L_{n,1})\} = \sum_{k_i=1}^{i} \sum_{k_{i+1}}^{i+1} \sum_{k_{i+2}}^{i+2} \\ &\qquad = k_{i+1} = k_{i+1} + 1 \\ &\sum_{k_{n-1}}^{n-1} \exp\{j\beta d(\sin\theta_{k_i}\cos\phi_{k_i} + \sin\theta_{k_{i+1}}\cos\phi_{k_{i+1}} + \\ &= k_{n-2} + 1 \\ &\quad \sin\theta_{k_{i+2}}\cos\phi_{k_{i+2}} + \ldots\ldots + \sin\theta_{k_{n-1}}\cos\phi_{k_{n-1}})\} \end{aligned} \tag{20}$$

where $i=i\sim n-1$ It is clear that this equation can hold. In other words, it is possible to realize the aforementioned directivity by using a design parameter $L_{i,k}$. By designing the power divider so as to hold equation (19) it is possible to always hold equation (18) irrespective of the variation in frequency. Although, in addition to the condition shown by equation (19) there are conditions $S_{i,k}'$ and $S_{k,s}^{(i)}$ that always satisfy equation (18), but in order to systematically process the design conditionsof the power divider and the phase shifter under completely isolated conditions, in other words, in order to design them by maintaining the power dividing condition and the phase shifting condition at completed independent relations, equation (19) is sufficiently practical.

Equation (20) shows that the line length $L_{i,k}$ of the phase shifter is determined as a function of a null point direction ($\theta_k$, $\phi_k$), and that a definite phase deviation may be permissible.

When $L_{i,k}$ is determined such that the exponent of equation (20) can be expressed as $$\begin{aligned} &L_{i,K}-L_{n,} \\ &\quad 1 = -d[\sin\theta_{k_i}\cos\phi_{k_i} + \sin\theta_{k_{i+1}}\cos\phi_{k_{i+1}} + \sin\theta- \\ &\quad k_{i+2}\cos\phi_{k_{i+2}} + \ldots + \sin\theta_{k-1}\cos\phi_{k-1}] \end{aligned} \tag{21}$$

the equation (20) holds irrespective of the variation in the frequency, that is $\beta$, so that the directivity pattern can be satisfactorily synthesized over a wide frequency band by designating (n−1) null directions.

Having completed the description of the theory a preferred embodiment of this invention will now be described.

Figure 3:
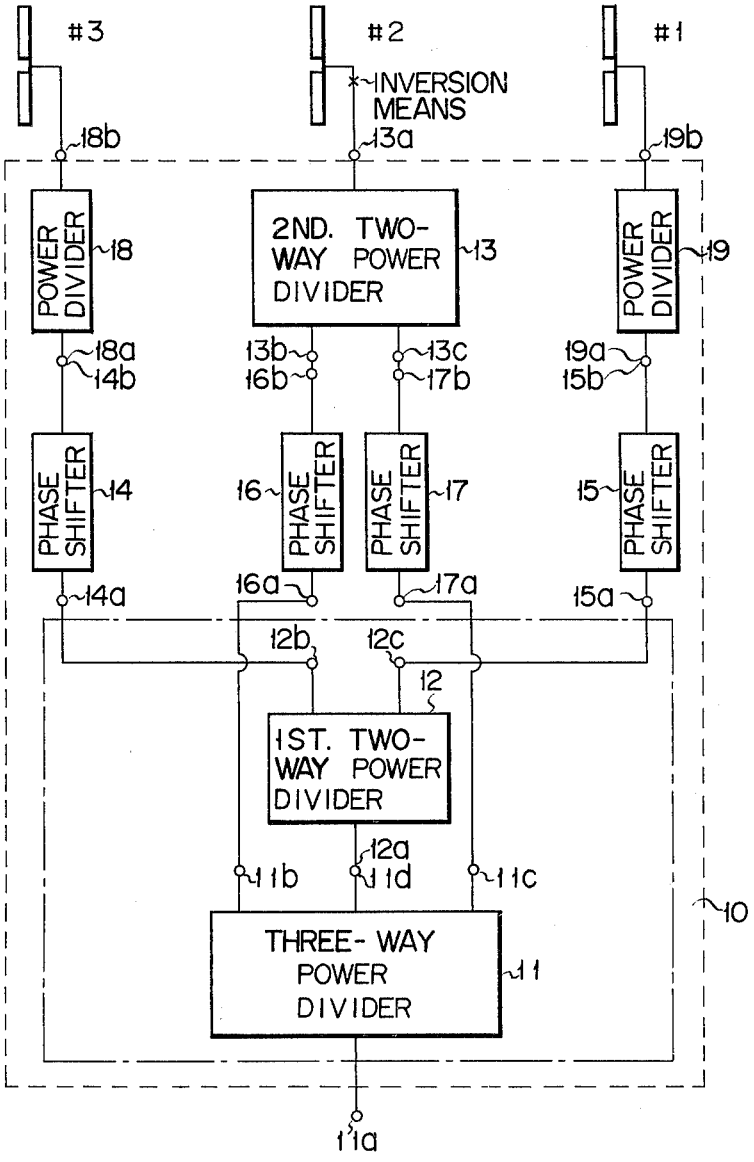
FIG. 3 is a block diagram showing one embodiment of this invention wherein the number of the element antennae is 3.

FIG. 3 is a block diagram showing an embodiment of this invention where the number of the element antennae is 3. The linear antenna array shown therein comprises three element antennae #1, #2 and #3 which are arranged along a straight line at an equal spacing and a feed circuit network 10 bounded by dotted lines.

The feed circuit network 10 comprises a three-way power divider 11 which in response to an input to a common port 11*a* produces three signals having the same amplitude and the same phase on three split ports 11*b*, 11*c* and 11*d*; first and second two-way power dividers 12 and 13 which in response to the inputs to the common ports 12*a* and 13*a* produce signals having the same phase and the same amplitude on two split ports 12*b*, 12*c* and 13*b*, 13*c*; first to fourth phase shifters 14, 15, 16 and 17 constructed to give a predetermined phase shifts according to the electrical lengths of the transmission lines, and a one-way power dividers 18 and 19.

For example, as the three-way power divider 11 may be used type M3V-50 divider manufactured by ANZAC company, while as the two-way dividers 12 and 13 may be used type MTV-50 divider of the same company.

The common port 12*a* of the two-way power divider 12 i connected to one split port of the three-way power divider 11 whereas the input ports 14*a*, and 15*b* of the first and second phase shifters 14 and 15 are converted respectively to the split ports 12*b* and 12*c* of the two-way divider 12. The other two split ports 11*b* and 11*c* of the three-way power divider 11 are connected to the input ports 16*a* and 17*a* respectively of the third and fourth phase shifters 16 and 17, and the output ports 16*b* and 17*b* thereof are connected to the split ports 13*b* and 13*c* respectively of the second two-way power divider 13. The common port 13*a* of the second three-way power divider 13 is connected to the element antenna #2 through an inversion means represented by a symbol X in FIG. 3. This symbol X is used in the description of the invention.

The output ports 14*b* and 15*b* of the first and second phase shifters 14 and 15 are respectively connected to the input ports 18*a* and 19*a* of the one-way power dividers 18 and 19, while the output ports thereof are connected to element antennae #3 and #1 with a polarity opposite to that of the element antenna #2. It should be understood that although the one-way dividers 18 and 19 are shown in the drawing to clarify their relationship to the principle of this invention, actually they are not necessary.

The element antennae connected to the output port 19*b*, the common port 13*a* and the output port 18*b* may be dipole antennae or antennae of the other type.

With the connection described above, when a signal to be radiated is applied to the common port of the three-way power distributor 11, this input signal would be divided into 3 which are applied to element antennae #1, #2 and #3 respectively through ports 19*b*, 13*a* and 18*b*.

It is advantageous to use power dividers having high degree of isolation among respective split ports as the three-way power divider 11 and the two-way power dividers 12 and 13. In this embodiment, the fact that the equation (19) is satisfied when the number of the element antennae is 3 will be described hereunder.

In FIG. 3, since the elements bounded by dot and dash lines correspond to the power divider $D_s$ shown in FIG. 2A, $S_{i,k}'$ and $S_{k,s}^{(i)}$, and their products in the case of i=1, 2 and 3 are calculated and shown in the following Table 1.

1

| i | k | $S_{i,k}'$ | $S_{k,s}^{(i)}$ | $S_{i,k}' \cdot S_{k,s}^{(i)}$ |
|---|---|---|---|---|
| 1 | 1 | $S_{11}' = 1$ | $S_{1s}^{(1)} = \frac{1}{\sqrt{3}} \cdot \frac{1}{\sqrt{2}}$ | $\frac{1}{\sqrt{6}}$ |
| 2 | 1 | $S_{21}' = \frac{1}{\sqrt{2}}$ | $S_{1s}^{(2)} = \frac{1}{\sqrt{3}}$ | $\frac{1}{\sqrt{6}}$ |
| | 2 | $S_{22}' = \frac{1}{\sqrt{2}}$ | $S_{2s}^{(2)} = \frac{1}{\sqrt{3}}$ | $-\frac{1}{\sqrt{6}}$ |
| 3 | 1 | $S_{31}' = 1$ | $S_{1s}^{(3)} = \frac{1}{\sqrt{3}} \cdot \frac{1}{\sqrt{2}}$ | $\frac{1}{\sqrt{6}}$ |

It will be thus noted that a condition $S_{i,k}' \cdot S_{k,s}^{(i)}$=constant, that is equation (19) is satisfied. To satisfy equation (21), the line length (electrical length) $L_{31}$, $L_{11}$, $L_{22}$ and $L_{21}$ of the first to fourth phase shifters are selected as shown in Table 2.

Table 2

| i | number of split sports $p_i$ | k | line length $L_{ik}$ of phase shifter |
|---|---|---|---|
| 1 | 1 | 1 | $L_{11} - L_{31} = -d(\sin\theta_1 \cdot \cos\phi_1) + \sin\theta_2 \cdot \cos\phi_2)$ |
| 2 | 2 | 1 | $L_{21} - L_{31} = -d(\sin\theta_1 \cdot \cos\phi_1)$ |
| | | 2 | $L_{22} - L_{31} = -d(\sin\theta_1 \cdot \cos\phi_2)$ |
| 3 | 1 | 1 | $L_{31}$ – any value |

When the line lengths of the first to fourth phase shifters are selected as above described, it is possible to form directive null points in a definite direction over a wide frequency band. However, the invention is not limited to such selection. For example, in the embodiment described above, although the first and second two-way power dividers 12 and 13 were constructed to produce signals having the same phase and the same amplitude, either one or both two-way power dividers may be constructed to produce signals having the same amplitude but opposite phase. In this case, the line lengths of the first to fourth phase shifters are selected correspondingly. Instead of using phase shifters whose amounts of phase shift are determined in accordance with the line length, the other type of phase shifters may also be used in which the amount of phase shift is proportional to the frequency.

Although a phase shift also occurs in a power divider, it is possible to treat it as a portion of the phase shift caused by the phase shifter.

For example, the phase shifts in the three-way power divider 11 between its common port 11*a* and the splits ports 11*b*, 11*c* and 11*d* are not required to be always equal because such difference can be compensated for by the first to fourth phase shifters 14 through 17.

Thus, with the embodiment shown in FIG. 3, it is possible to provide a three element antennae array having a simple construction and can form null points in the desired and definite two directions over a wide frequency range.

Figure 4:
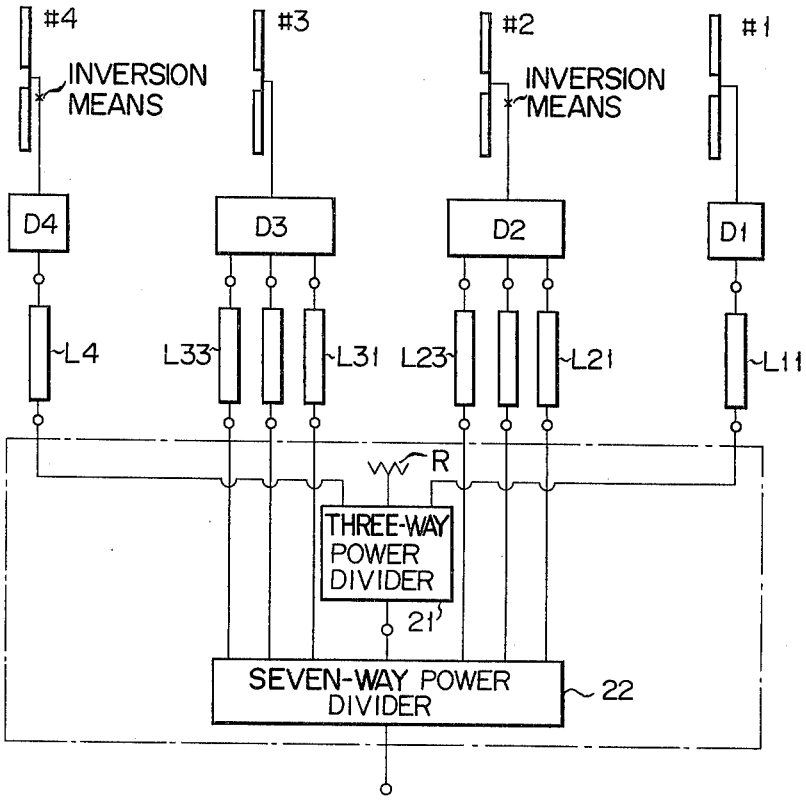
FIG. 4 is a block diagram showing another embodiment of this invention wherein the number of the element antennae is 4.

An embodiment of this invention wherein the number of the element antennae is four will now be described with reference to FIG. 4. This modified embodiment comprises 4 element antennae #1 through #4 arranged along a straight line with an equal spacing, one-way power dividers $D_1$ and $D_4$, three-way power dividers $D_2$ and $D_3$, and transmission line type phase shifters $L_{11}$, $L_{21}$ to $L_{23}$, $L_{31}$ to $L_{33}$ and $L_4$, the transmission line lengths thereof being designated by the same reference characters. In FIG. 4, the elements bounded by dot and dash lines correspond to the power divider $D_s$ shown in FIG. 2A.

The power divider $D_s$ is constituted by a three-way power divider 21 having one split port connected to a dummy resistance R and a seven-way power divider 22. (which divides an input power into 7 outputs). Each of the three-way power dividers $D_2$, $D_3$ and 21 is constructed to produce on its three split ports signals having substantially the same phase and the same amplitude in response to a signal applied to its common input port whereas seven-way power divider 22 is constructed to produce signals having substantially the same phase and the same amplitude on its 7 shift ports in response to an input signal supplied to the common input ports.

In the embodiment shown in FIG. 4 too, the equation (19) described in connection with the principle of this invention is satisfied. The transmission line lengths $L_{11}$, $L_{21}$ to $L_{23}$, $L_{31}$ to $L_{33}$ and $L_{41}$ of respective phase shifters necessary to satisfy equation (21) are shown in the following Table 3.

Table 3

| i | number of split ports $p_i$ | k | line length $L_{ik}$ of phase shifter |
|---|---|---|---|
| 1 | 1 | 1 | $L_{11} - L_{41} = -d(\sin\theta_1 \cdot \cos\phi_1 + \sin\theta_2 \cdot \cos\phi_2 + \sin\theta_3 \cdot \cos\phi_3)$ |
| | | 1 | $L_{21} - L_{41} = -d(\sin\theta_1 \cdot \cos\phi_1 + \sin\theta_2 \cdot \cos\phi_2)$ |
| 2 | 3 | 2 | $L_{22} - L_{41}' = -d(\sin\theta_1 \cdot \cos\phi_1 + \sin\theta_3 \cdot \cos\phi_3)$ |
| | | 3 | $L_{23} - L_{41} = -d(\sin\theta_2 \cdot \cos\phi_2 + \sin\theta_3 \cdot \cos\phi_3)$ |
| | | 1 | $L_{31} - L_{41} = -d \cdot \sin\theta_1 \cdot \cos\phi_1$ |
| 3 | 3 | 2 | $L_{32} - L_{41} = -d \sin\theta_2 \cos\phi_2$ |
| | | 3 | $L_{33} - L_{41} = -d \cdot \sin\theta_3 \cdot \cos\phi_3$ |
| 4 | 1 | 1 | $L_{41}$ = any length |

Figure 5:
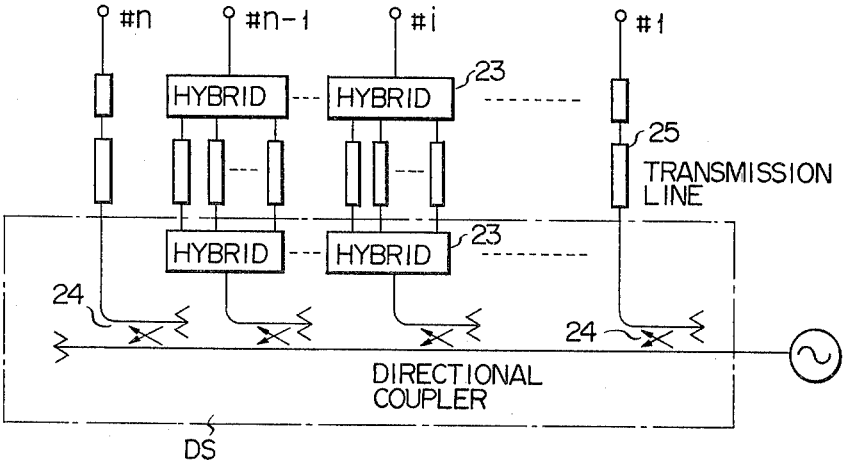
FIG. 5 is a block diagram showing still further embodiments of this invention wherein the number of the element antennae is n.

Still another embodiment of this invention wherein the number of the element antennae is n will be described with reference to FIG. 5 in which a power divider corresponding to the power divider $D_s$ shown in FIG. 2A is constituted by Wilkinson type n-way hybrid power dividers 23 and directional coupler 24. In this embodiment too, it is possible to form (n−1) null points whose directions do not vary over a range of from low frequencies to high frequencies by adjusting the circuit parameters to satisfy equations (19) and (21).

Figures 6A, 6B, 6C:
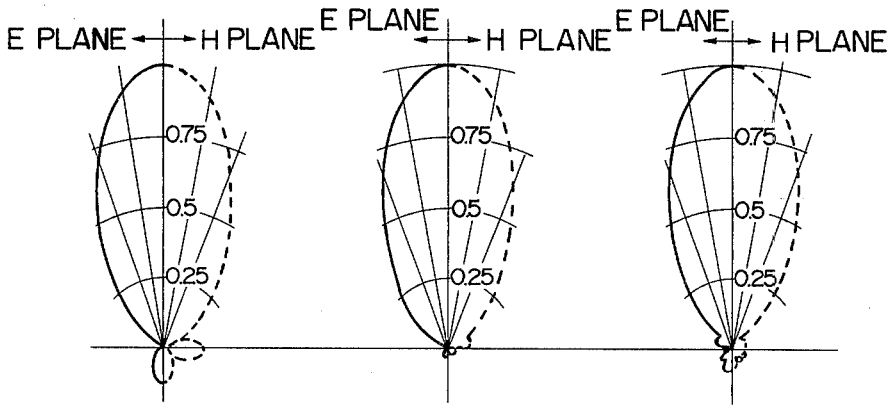
FIGS. 6A, 6B and 6C are polar diagrams showing the directivity of the linear antenna array according to this invention.

Although in the foregoing description of the feed network, it was explained that the common ports of the power dividers $D_1$ through $D_n$ and $D_s$ are matched to a reference impedance $Z_o$ for the sake of the easy understanding of this invention, a problem occurs whether the invention is effective or not when these common ports are not matched to the reference impedance $Z_o$. Where a dipole antenna is used as the element antenna, it is considered that its input impedance may not match with the reference impedance over a wide frequency band. In addition, the mutual coupling between element antennae should also be considered. However, notwithstanding these facts, the invention is sufficiently effective. Thus, where the number of the element antennae is seven, the total length of a dipole antenna is 100 cm, the diameter thereof is 0.95 cm, and the spacing d between element antennae is 40 cm, the directivity patterns were synthesized by designating the directive null points in 6 directions of 50°, 70°, 90°, 110°, 140° and 180° measured from the X axis direction shown in FIG. 2B and the resulting directivity patterns are shown in FIGS. 6A, 6B and 6C which show the directivities in the E-plane and H-plane for 90 MHz, 170 MHz and 222 MHz respectively. These patterns are examples of the results when the frequency bands of the television broadcasting waves utilized in Japan are used. It can be noted that sharp pencil beam shaped directivity patterns can be obtained in which the main beam width has been decrease over an extremely wide frequency band and the side lobe levels have been suppressed. These characteristics were obtained by also taking into consideration the effect of the mutual coupling showing the utility of the antenna of this invention. In other words, FIGS. 6A, 6B and 6C show that the antenna of this invention has an effective operating range over an extremely wide frequency range. The reason that the side lobe and back lobe levels of the directivity patterns shown in FIGS. 6A and 6C for 90 MHz and 222 MHz are not perfectly suppressed is that the radiation patterns are effected principally by the mutual coupling.

To confirm experimentally the directivity pattern synthesis of the antenna of this invention.

I calculated directivity patterns for a 3-element endfire array and manufactured its antenna for experiment.

As the frequency band was selected a band of from 90 to 220 MHz covering more than one octave and utilized in Japanese television broadcasting systems. The dimensions of the three element array are:

Total length of the dipole antenna=120 cm
Diameter of the dipole antenna=0.95 cm
Spacing between element antennae d=45 cm
Number of the element antennae n=3.

Figure 7A:
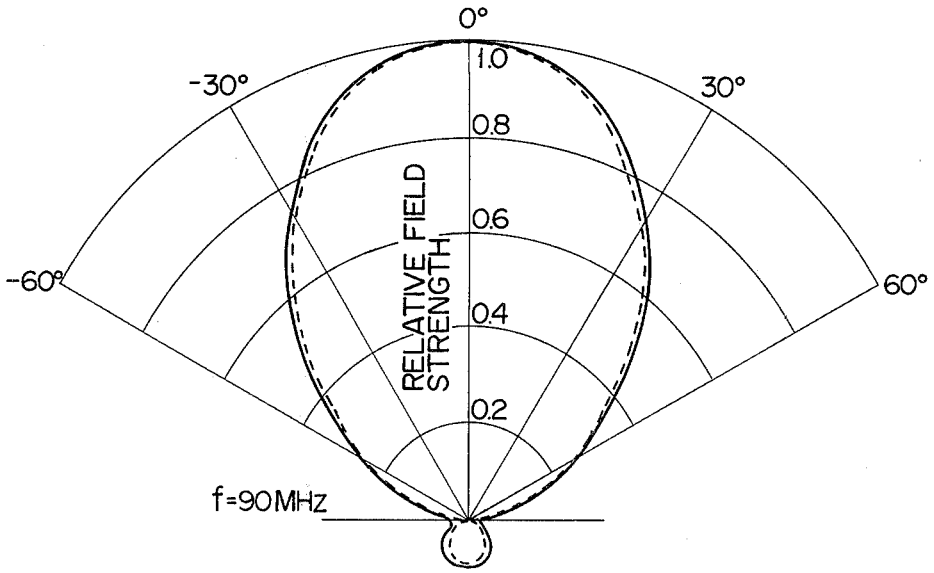
FIGS. 7A, 7B and 8A, 8B and 8C are polar diagrams respectively showing the E-plane directivity and the H-plane directivity of this invention utilizing 3 element antennae.
Figure 7B:
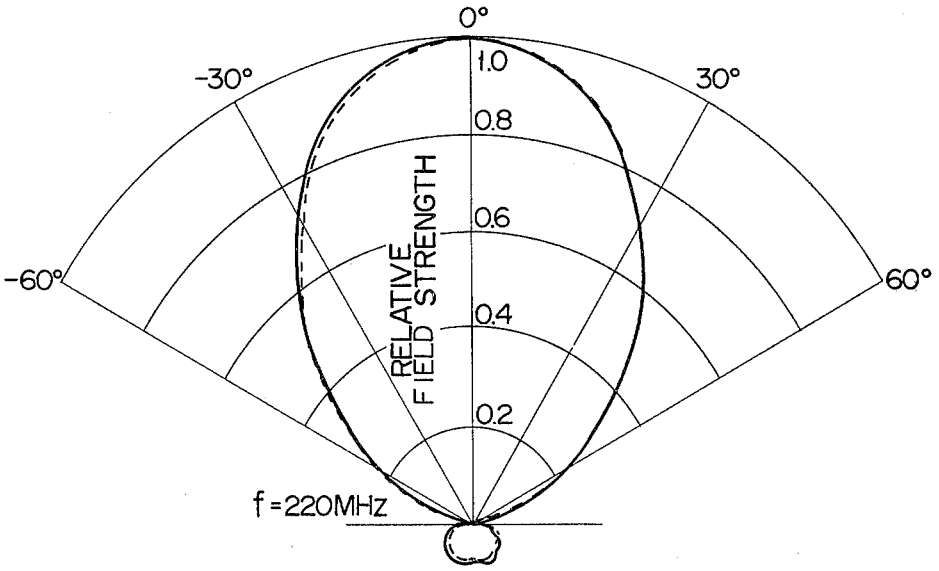

Since the directions of the directive null points are given by n−1=2, two directions of 120° and 180° measured from the radiation direction along the array axis were designated as the null point directions. The results of calculations under these conditions are shown by dotted lines in FIGS. 7A, 7B and 8A, 8B, 8C. These synthesized theoretical values are directivity patterns obtained under the condition of the mutual couplings between the elements. As can be noted from these drawings, even when the radiation mutual coupling presents, the radiation in the designated null point directions was suppressed over a frequency range of about 1.5 octaves (90 to 220 MHz), thus forming small side lobe levels. As shown in FIGS. 7A and 7B, the E-plane directivity patterns for 90 MHz and 220 MHz are substantially the same. It is to be particularly noted that the configuration of the E-plane directivity is substantially the same over a wide frequency range including calculated values of the directivities between 90 MHz and 220 MHz. The incomplete suppression of the directivity in the designated direction is caused by the mutual coupling between element antennae.

The feed circuit network utilized in this experiment was constructed as a combination of a hybrid type two-way power divider and a three-way power divider having the same phase and the same amplitude and the measured degree of isolation of respective power divider was about 30 dB and their measure amplitude error was about ±0.1 dB. For this reason, it is thought that equation (19) is substantially satisfied. To synthesize null points in the directions of 120° and 180° from the array axis, the line lengths $L_{11}$, $L_{21}$, $L_{22}$ and $L_{31}$ of the phase shifters were designed as follows from equation (21)

$L_{11}$=96 cm (physical length)
$L_{21}$=74 cm (physical length)

$L_{22}=59$ cm (physical length)
$L_{31}=44$ cm (physical length)

Figure 8A:
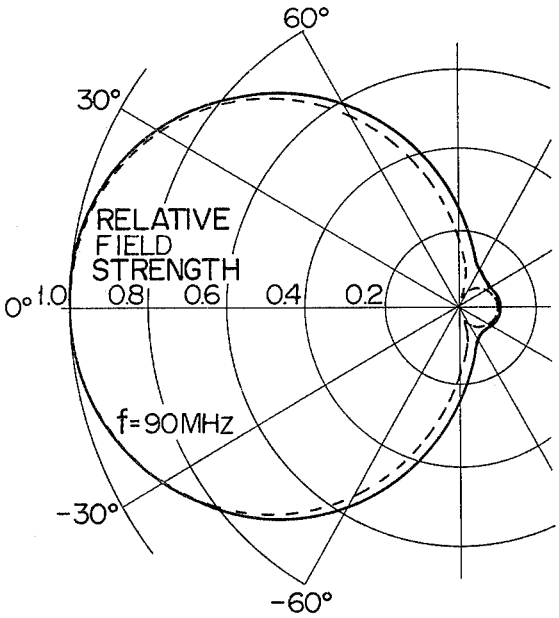
Figure 8B:
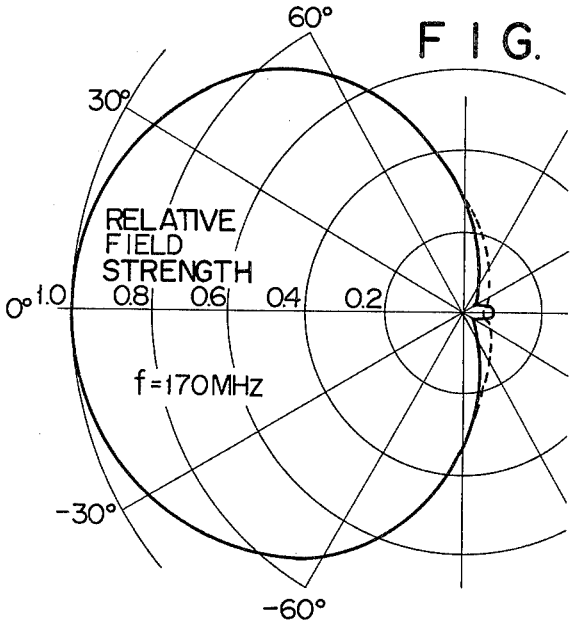
Figure 8C:
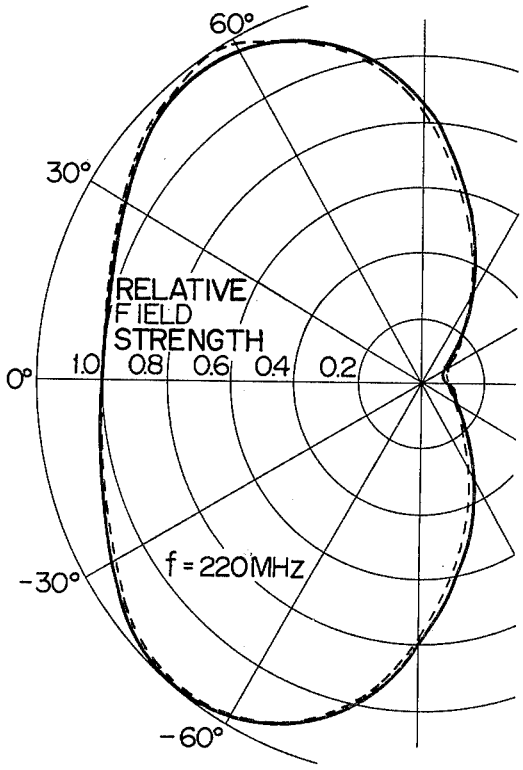

The measured values of the E-plane directivity pattern of this antenna are shown by solid lines in FIGS. 7A and 7B respectively, whereas the measured values of the H-plane directivity pattern are shown by solid lines in FIGS. 8A, 8B and 8C respectively. As shown in these figures, the measured values are in good agreement with the theoretical value for both E and H planes.

It should be understood that the invention is not limited to the illustrated embodiments and that various modifications and applications are possible. For examles, although in foregoing embodiment, in the case where the power divider is of the same phase division type, for the purpose of alternately reversing the phase between the feed port A and the feed ports of element antennae, the common ports of the first power dividers were connected in alternate reverse polarities, it is possible to alternately reverse the connections in a power divider, or to reverse the polarity in the transmission lines while constitute phase shifters.

A power divider utilized in a feed circuit network may be designed so as to have a specified amount of phase shift. Such phase shift can be treated by adding a portion of the phase shift into the electrical length $L_{ik}$.

Moreover, instead of directly connection the common ports of the first power dividers to the feed port of the element antenna, it is possible to connect the feed ports of element antennae to the common ports of the feed circuit network bounded by dotted lines in FIG. 2A after passing through an amplifier and a frequency converter for producing an intermediate frequency. Using such modified connections this invention can also synthesize the desired directivity pattern of this invention over a wide frequency range. As above described, the number of the directive null points of the antenna of this invention is up to (n−1) where n represents the number of the element antennae, but it is possible to select it such that some of the directions coincide with each other. In this case, some identical transmission lines of $p_i$ phase shifters corresponding shifters corresponding to the i-th element antenna #i may be made common.

Where (n−1) null point directions are the same in a case wherein n element antennae are used, the number of the transmission lines of the phase shifters may be reduced to one for the each element antenna. However, when the number of the transmission lines is reduced to one, the null point can be formed in only one direction thus making it impossible to synthesize the desired directivity. In contrast, according to this invention, as it is possible to form up to (n−1) null points in any direction which do not depend upon the frequency whereby it becomes possible to synthesize desired directivities pattern over a wide frequency band. To make equal all null points is nonsense, but to make equal some null points among (n−1) null points is valuable. In this case, identical transmission lines connected to each divider may be combined into a common line.

What is claimed is:

1. An antenna array for providing a plurality of frequency independent, variable null point directions comprising:

a linear antenna array including three or more individual antenna elements, a plurality of individual power dividers each having a common port coupled to one of said individual antenna elements, each of said individual power dividers also being provided with a number $P_i$ of split ports where $P_i$ is a binomial coefficient expressed by the equation $$P_i={}_{n-1}C_{i-1}$$

wherein n represents the number of antenna elements and i the number of a particular individual antenna element counted from one end of said array, a plurality of phase shifting means coupled to said split ports for producing frequency dependent phase shift, a common power divider having a single input port and a plurality of split ports coupled to said phase shifting means; and, phase inversion means coupled to said individual antenna elements for reversing the phase signals applied to alternate antenna elements, whereby a signal pattern is produced having a plurality of frequency independent null points, said null points positionable in predetermined directions.

2. The linear antenna array according to claim 1 wherein each element antenna comprises a dipole antenna.

3. The linear antenna array according to claim 1 wherein each said phase shifting means comprises a transmission line having a predetermined electrical length.

4. The linear antenna array according to claim 1 wherein said common power divider comprises a plurality of n-way hybrid power dividers.

5. The linear antenna array according to claim 4 wherein said common power divider further comprises at least one directional coupler.

6. The linear antenna array according to claim 1 wherein said common power divider comprises a plurality of dividers which is response to an input supplied to its common port produces signals having the same amplitude on a plurality of split ports of said dividers.

7. The linear antenna array according to claim 1 wherein each element antenna comprises a dipole antenna.

8. A linear antenna array comprising:

three-way power dividing means having a common port and three split ports for producing signals having the same amplitude at said three split ports in response to application of an input signal at said common port, first two-way power dividing means having a common port and two split ports, said common port coupled to one of said split ports of said three-way power dividing means, for producing signals having the same amplitude at said two split ports in response to an input signal applied to said common port, first and second phase shifters respectively coupled to said two split ports of said two-way power dividing means, third and fourth phase shifters respectively coupled to said two remaining split ports of said three-way power dividing means, second two-way power dividing means having a common port and two split ports for producing signals having equal amplitudes at said split ports in response to application of a signal at said common port in accordance with the reciprocity theorum, said two split ports of said second two-way power divider coupled to said third and fourth phase shifters; and three antenna elements respectively coupled to said first and second phase shifters and to said common port of said second two-way power dividing means, said connection between said common port of said second two-way power dividing means and one of said three antenna elements being arranged to reverse the phase of one of said antenna elements with respect to said other two antenna elements.

9. The linear antenna array according to claim 8 wherein each phase shifter comprises a transmission line having a predetermined electrical length.

10. A linear antenna array comprising:

seven-way power dividing means having a common port and seven split ports for producing signals of equal amplitude at said split ports in response to the application of a signal to said common port, first three-way power dividing means having a common port and three split ports, said common port coupled to one of said split ports of said seven-way power dividing means, for producing signals of equal amplitude at said three split ports, first and second phase shifters respectively coupled to two of said three split ports of said first three-way power dividing means, third, fourth, fifth, sixth, seventh and eighth phase shifters respectively coupled to said remaining six split ports of said seven-way power divider, second three-way power dividing means having a common port and three split ports, said three split ports coupled to said third, fourth and fifth phase shifters, respectively;

third three-way power dividing means having a common port and three split ports, said three split ports coupled to said sixth, seventh and eighth phase shifters, respectively; and four antenna elements coupled respectively to said first and second phase shifters and to said common ports of said second and third three-way power dividing means, said antenna element coupling respectively reversing the phase of alternate antenna elements.

11. The linear antenna array according to claim 10 wherein each element antenna comprises a dipole antenna.

12. The linear antenna array accoding to claim 10 wherein each phase shifter comprises a transmission line having a predetermined electrical length.

13. A linear antenna array comprising:

at least three individual antenna elements arranged in a linear configuration, a plurality of individual power dividers, each corresponding to one of said antenna elements, each of said individual power dividers being provided with a common port coupled to a particular antenna element, each of said individual power dividers further being provided with ports of a number corresponding to a binomial coefficient which is expressed by an equation $$P_i = {}_{n-1}C_{i-1}$$

where $P_i$ represents the number of said split ports, n represents the number of said antenna elements and i represents the number of a particular antenna element counted from one end of said array, a plurality of phase shifters coupled to said split ports of said individual power dividers, each said phase shifter producing a phase shift which varies with frequency, a common power divider having a plurality of split ports coupled to said phase shifters and having a common feed port; and means coupled between said common power divider and said individual antenna elements for reversing the relative phase of alternate ones of said antenna elements.

* * * * *